United States Patent [19]

Hönig

[11] Patent Number: 4,748,940

[45] Date of Patent: Jun. 7, 1988

[54] STEAM GENERATOR HAVING A CIRCULATING BED COMBUSTION SYSTEM AND METHOD FOR CONTROLLING THE STEAM GENERATOR

[75] Inventor: Josef Hönig, Gummersbach, Fed. Rep. of Germany

[73] Assignee: L. & C. Steinmüller GmbH, Gummersbach, Fed. Rep. of Germany

[21] Appl. No.: 77,605

[22] Filed: Jul. 24, 1987

[30] Foreign Application Priority Data

Jul. 26, 1986 [DE] Fed. Rep. of Germany ..... 3625373

[51] Int. Cl.[4] ..... F22B 1/00

[52] U.S. Cl. ..... 122/4 D; 165/104.16

[58] Field of Search ..... 122/4 D; 431/7, 170; 165/104.16; 110/245

[56] References Cited

U.S. PATENT DOCUMENTS 4,312,301 1/1982 Anson ..... 122/4 D 4,473,032 9/1984 Maintok ..... 122/4 D 4,709,663 12/1987 Larson et al. ..... 122/4 D

*Primary Examiner*—Edward G. Favors

*Attorney, Agent, or Firm*—Becker & Becker, Inc.

[57] ABSTRACT

In case of a steam generator having a circulating atmospheric or pressurized fluidized-bed combustion system, normally a fluidized-bed combustor, at least one separator, at least one fluidized-bed cooler connected to said separator and adapted to be fed by a part stream of the solids separated from the combustion and fluidization gases, and a waste-heat boiler pass are provided. In these elements feed water, evaporator and reheating surfaces are arranged. Together with a reheater heating surface at least one superheater heating surface is arranged in the fluidized-bed cooler and an adjustable by-pass line is associated to the reheater heating surface to allow a simple and quick control of the combustion while simultaneously offering a simple control of the outlet temperature of the reheater.

9 Claims, 2 Drawing Sheets

STEAM GENERATOR HAVING A CIRCULATING BED COMBUSTION SYSTEM AND METHOD FOR CONTROLLING THE STEAM GENERATOR

FIELD OF THE INVENTION

This invention relates to a steam generator having a circulating atmospheric or pressurized fluidized-bed combustion system including a fluidized-bed combustor, a separator, a fluidized-bed cooler, wherein the separated solids are recycled to the fluidized-bed combustor and/or the fluidized-bed cooler and heat of combustion is dissipated through cooling surfaces.

BACKGROUND OF THE INVENTION

From European Patent Letter No. 068 301 a steam generator is known, with which in a first fluidized-bed cooler an evaporator heating surface with a by-pass line in parallel thereto and in a second fluidized-bed cooler only heating surfaces for reheating are arranged. With this arrangement the heating of the reheating steam is controlled by the bed temperature which is in turn influenced by the solids stream recycled via said fluidized-bed cooler.

Further from the periodical "Modern Power Systems", December/January 1984/85, p. 57, a steam generator is known with which two evaporator heating surfaces and two reheater heating surfaces are arranged in separate fluidized-bed coolers. By-pass lines are not provided; an injection cooler is, however, interconnected between the two reheater heating surfaces. By means of this injection cooler and the solids stream fed to the fluidized-bed cooler the temperature control of the reheater outlet temperature is provided.

With the known steam generators a simple influence on the heat balance in the combustion loop: fluidized-bed combustor, separator, fluidized-bed cooler, fluidized-bed combustor is not possible. In case of large and quick load variation there is unsufficient control behavior with respect to keeping a substantially constant reheater outlet temperature and a substantially constant flue gas inlet temperature in the waste-heat boiler pass.

From the German periodical "VGB-Kraftwerkstechnik", Vol. 5, p. 373, FIG. 12, a steam generator is known, with which two fluidized-bed coolers are provided, in each of which three heating surfaces of the same type are arranged.

OBJECT OF THE INVENTION

It is an object of the invention to provide a steam generator, in which the known disadvantages, particularly those mentioned herein before, are avoided. A further object of the invention is to provide a steam generator with which a simple and quick influence on the combustion side and simultaneous simple control of the reheater outlet temperature is possible.

SUMMARY OF THE INVENTION

With a steam generator having a circulating atmospheric or pressurized fluidized-bed combustion system consisting of a fluidized-bed combustor, at least one separator, at least one fluidized-bed cooler connected to said separator and adapted to be fed by a part stream of the solids separated from combustion flue gases, and a waste-heat boiler pass, in which feed water heater, evaporator and reheater heating surfaces are arranged, of which heating surfaces at least one evaporator heating surface is arranged in said fluidized-bed combustor and at least one reheater heating surface is arranged in said fluidized-bed cooler, and at least one adjustable by-pass line is connected in parallel to one of the heating surfaces, the invention is characterized primarily by arranging at least one superheater heating surface in said fluidized-bed cooler together with said reheater heating surface and associating said adjustable by-pass line to said reheater heating surface.

By arranging a superheater heating surface together with the reheater heating surface having the by-pass line in the fluidized-bed cooler, remarkable control dynamics are achieved even in case of large and quick load variations in contrary contrast to a reheating temperature control with the use of injection coolers. Further the heat dissipation or absorption distribution between the heating surfaces in the fluidized-bed cooler can be influenced by means of the by-pass line. The by-pass stream varies for the reheater heating surface in the fluidized-bed cooler the inner heat transfer number on the one hand and the logarithmic temperature difference on the other hand. Between the transferred or dissipated heat stream and the by-pass stream consists a more or less linear dependency.

Thus the heat balance in the combustion loop and the heat distribution between the combustion loop and the waste-heat boiler pass can be influenced by varying the solid streams led over the fluidized-bed cooler, while the reheater outlet temperature can be kept by corresponding adjustment of the by-pass line. When starting the operation of the known steam generator the fluidized-bed cooler may lag the temperature of the fluidized-bed combustor so that in the reheater heating surface condensation and water pulses may be at hand. These deficiencies are also avoided with the steam generator according to the present invention.

Pursuant to another specific embodiment of the present invention, in said fluidized-bed cooler a second superheater heating surface is provided, which is connected to the inlet of said first superheated heating surface, and an overflow-wall is arranged between the two superheater heating surfaces to improve the thermal coupling between the reheater heating surface and the first superheater heating surface. This coupling is further improved, if the two heating surfaces are nested one into the other.

Pursuant to yet another proposal of the present invention a second reheater heating surface arranged in said waste-heat boiler pass is connected to the inlet of said first reheater heating surface arranged in the fluidized-bed cooler. The value of the by-pass stream depends in case of like controllability of the reheater heating outlet temperature on the warm-up span. The by-pass stream is lowest, if the entire reheating area is arranged in the fluidized-bed cooler. Thus, it is of advantage, if the entire reheating area is distributed between the fluidized-bed cooler and the waste-heat boiler pass as described herein before.

It is further of advantage, if a further by-pass line is associated also to the second reheater heating surface to allow influencing of the heat distribution over the reheater heating surfaces on the one hand and the heat distribution between the combustion loop and the boiler pass on the other hand.

It is further of advantage, if a special mixing section is provided at the outlet end of each by-pass line. The by-pass control is only limited by the materials used. The more steam has to be by-passed the higher the design temperature for the heating surface and the mixing section has to be. Preferably the mixing section includes an outer case and a venturi-like insert welded at one end thereof to said outer case. Hot steam flows axially through said venturi-like insert and cold steam enters into an annular space between the outer case and the outer surface of said insert and enters from said annular space via an annular gap into said hot steam.

The invention is further directed to a method of controlling the steam generator described herein before.

The inventive method is primarily characterized in that, it includes the step of opening said by-pass line associated to said first reheater heating surface in said fluidized-bed cooler to greater extent in case of increase of the solids stream fed to said fluidized-bed cooler and closing it to a greater extent in case of decrease of said solids stream.

BRIEF DESCRIPTION OF THE DRAWING

The invention will now be explained more fully and by way of example with reference to the accompanying drawing. In the drawing.

SPECIFIC DESCRIPTION OF PREFERRED EMBODIMENTS

Figure 1:
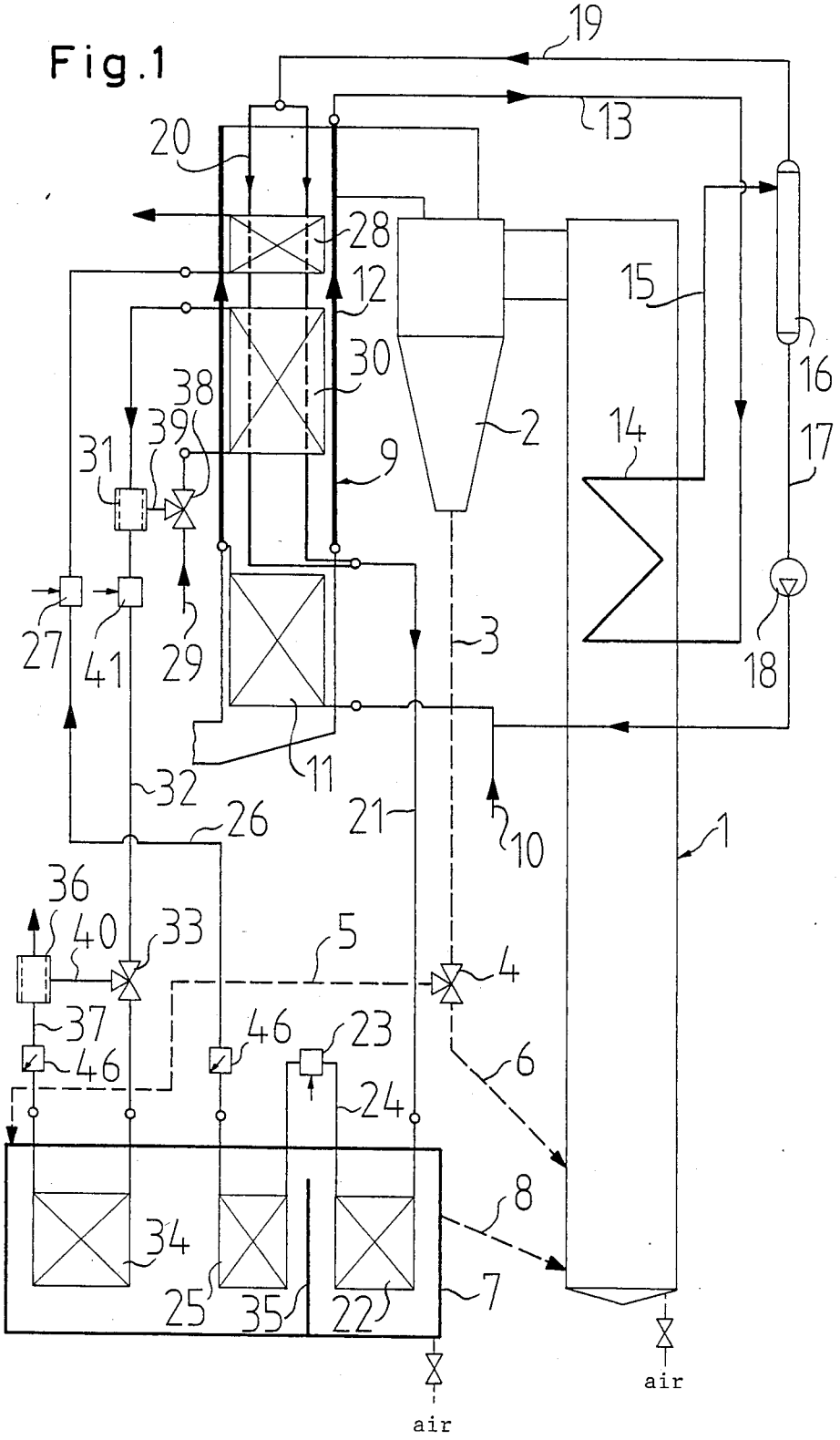
FIG. 1 is a principle diagram of one embodiment of the steam generator.

The steam generator includes a fluid-bed combustor or combustion chamber (1) to which in a manner not discussed in detail combustible material, possibly an additive, primary air and secondary air are fed. The solid material carried away from the fluid-bed combustor by the combustion and fluidization gases are separated in a separator (2). The separated solids are led via a solids conduit (3) to a 3-way- distributor (4), which distributes the solid material into two solids conduits (5) and (6), one of which opens into a fluidized-bed cooler (7) and the other of which opens into the fluid-bed combustor (1). The solids cooled in the fluidized-bed cooler (7) are also led via a conduit (8) to the fluid-bed combustor (1). The gas leaving the separator (2) enters with a temperature of 850° C. e.g. into a waste-heat boilder pass (9) and leaves the waste-heat boiler pass (9) at the lower end thereof.

Feed water coming via a line (10) from a not-shown source thereof is preheated in a feed water preheater heating surface (11) in the form of a platen or partition heating surface and thereafter in a feed water preheater heating surface (12) in the form of a wall heating surface. The preheated water is fed via line (13) to an evaporator heating surface (14) of the fluid-bed combustor (1), which evaporator heating surface has preferably the form of a wall heating surface. The heating surface (14) is connected via line (15) to a sediment vessel (16). Sedimented water is recycled via line (17) having a pump (18) therein to the inlet of the preheater heating surface (11). From the sediment vessel (16) steam is fed via a line (19) to a first superheat heating surface (20), which heating surface is made of supporting tubes. Via line (21) steam flows from the superheater heating surface (20) to a superheater heating surface (220 arranged in the fluidized-bed cooler (7) and therefrom via a line (24), which can be provided with an injection cooler (23), to a further superheater heating surface (25) in the fluidized-bed cooler. The thus superheated steam is fed via line (26), which may include an injection cooler (27), to a final superheater heating surface (28), which is arranged in the form of a partition heating surface in the upper section of the waste-heat boiler pass (9), and flows therefrom to a steam turbine not shown.

From the steam turbine the steam is fed for the purpose of reheating via a line (29) to a reheater heating surface (30), which is arranged in the waste-heat boiler pass (9) in the manner shown in FIG. 1. Via a line (32) including a mixing section (31) the steam heated in the heating surface (30) is fed via a 3-way valve (33) to a further reheater heating surface (34) in the fluidized-bed cooler (7). The heating surfaces (25) and (34) are inserted into one another and are separated within the fluidized-bed cooler (7) from the superheater heating surface (22) by an overflow-wall (35). The solids conduit (5) opens into the fluidized-bed cooler (7) in the area of the heating surfaces (25) and (34) nested or inserted into one another. The superheated steam is fed back to the turbine via line (37) including a mixing section (36). In the feed line to heating surface (34) there is provided a 3-way valve (38) which is connected to the mixing section (31) via a by-pass line (39). The 3-way valve (33) is connected to the mixing section (36) via a by-pass line (40). Alternatively with respect to the by-pass arrangement (31, 38, 39) it is possible to use an injection cooler (41) provided in line (32). It is, however, preferred to use also in case of the superheater heating surface (30) a by-pass control.

During the operation of the steam generator, for example at the flue gas inlet to the waste-heat boiler pass (9), an inlet temperature of 850° C. is to be kept over the entire load range, while a constant reheater outlet temperature of 535° C. shall be kept. If now via the evaporator heating surface (14) less heat is absorbed, the flue gas temperature at the inlet of the waste-heat boiler pass (9) may increase. To avoid this increase the 3-way distributor (4) is adjusted such that more solids are fed via conduit (5) to the fluidized-bed cooler (7). To avoid in this connection an increase of the outlet temperature of the reheater the 3-way valve (33) is so adjusted that a corresponding part stream of the steam from heating surface (30) is fed via by-pass line (40) to the mixing section (36), so that the wanted reheating temperature is kept at the outlet of the mixing section (36). Over the entire load range it can thus be provided in a very simple manner that the reheater outlet temperature as well as the flue gas inlet temperature at the inlet of the waster-heat boiler pass (9) can be kept substantially constant.

Figure 2:
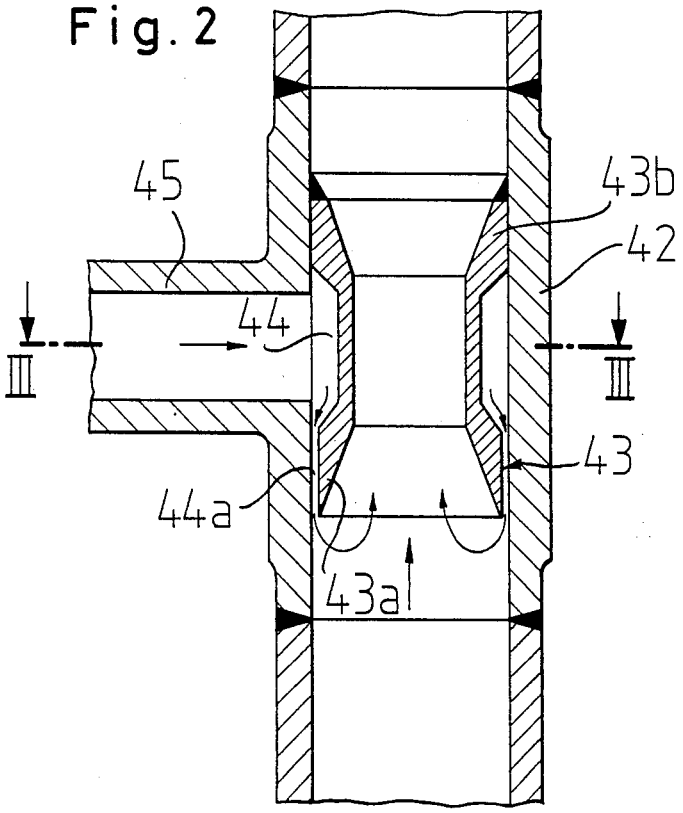
FIG. 2 is a longitudinal section of a mixing pass as can be used with the steam generator according to FIG. 1
Figure 3:
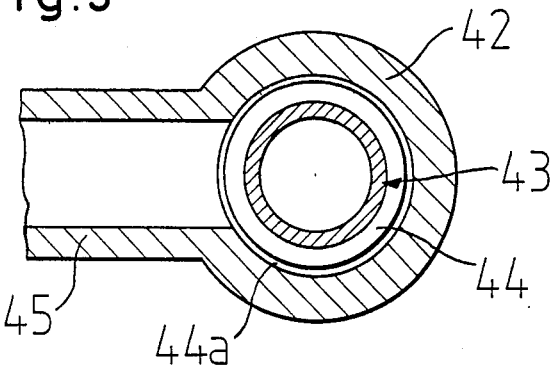
FIG. 3 is a cross section along line III—III in FIG. 2

In FIG. 2 a preferred embodiment for the mixing section is shown. The mixing section includes an outer case (42), into which the hot steam enters (in FIG. 2 from below). In the outer case there is arranged a venturi-like insert (43) in such a manner that between the inner surface of the outer case and the outer surface of the insert an annular space (44) is provided. The diameter of the inlet (43*a*) of the insert (43) is selected such that the annular space (44) is connected via an annular gap (44*a*) with the interior of the outer case (42). The outlet (43*b*) is sealingly welded to the inner surface of the outer case. The steam stream to be by-passed is fed via an inlet connector or stub (45) connected to the by-pass line into the annular space (44) and leaves the annular space via annular gap (44*a*) in counter current flow to the hot steam and is mixed into the hot steam while being deflected. Preferably the outer case (42)

and the stub (45) have the form of a one-piece T-configuration. With this arrangement the mixing of the colder steam can be provided without thermal shocks and negligible thermal stresses for the insert and/or the outer case. By using a venturi-like insert (43) a pressure drop is avoided as far as possible.

In certain cases of use it might be expedient to provide between line (21) and line (26) a further by-pass arrangement including a 3-way valve, a by-pass line and mixing section. Preferably check valves or flaps (46) are provided in lines (37) and (26), respectively.

The present invention is, of course, in no way restricted to the specific disclosure of the specification and drawings, but also encompasses any modifications within the scope of the appended claims.

What I claim is:

1. In a steam generator having a circulating atmospheric or pressurized fluidized-bed combustion system that includes a fluidized-bed combustor, at least one separator, at least one fluidized-bed cooler connected downstream of said separator and adapted to be fed by a partial stream of the solids separated from combustion and fluidization gases, and a waste-heat boiler pass, with various ones of these components having disposed therein feed water heater heating surfaces, evaporator heating surfaces, and reheater heating surfaces, with at least one evaporator heating surface being disposed in said fluidized-bed combustor and at least one reheater heating surface being disposed in said fluidized-bed cooler, and with at least one adjustable by-pass line being connected in parallel to one of said heating surfaces, the improvement wherein:

at least one superheater heating surface is disposed in said fluidized-bed cooler together with said reheater heating surface, and a first adjustable by-pass line is associated with said reheater heating surface.

2. A steam generator according to claim 1, in which a first superheater heating surface having an inlet is disposed in said fluidized-bed cooler, and a second superheater heating surface is disposed in said fluidized-bed cooler and is connected to said inlet of said first superheater heating surface, with an overflow wall being disposed between said first and second superheater heating surfaces.

3. A steam generator according to claim 1, in which a first reheater heating surface having an inlet is disposed in said fluidized-bed cooler, and a second reheater heating surface is disposed in said waste-heat boiler pass and is connected to said inlet of said first reheater heating surface.

4. A steam generator according to claim 3, in which a second by-pass line is associated with said second reheater heating surface.

5. A steam generator according to claim 3, in which each of said by-pass lines has an outlet end with which is associated a respective special mixing section.

6. A steam generator according to claim 5, in which each of said mixing sections comprises: an outer case with an inner wall, and a venturilike insert having an outer wall and two ends, one of which is welded to said outer case, and the other of which is spaced from said outer case in such a way that an annular gap is formed between said inner wall of said outer case and said outer wall of said insert, with that portion of said insert between said two ends thereof having a smaller outer diameter than either of said two ends so that an annular space is formed between said inner wall of said outer case and said outer wall of said insert, with said annular space communicating with said annular gap, whereby hot steam is adapted to flow axially through said insert, and cold steam is adapted to enter said annular space and from there to enter said hot steam via said annular gap.

7. A steam generator according to claim 1, in which said by-pass line has an outlet end with which is associated a special mixing section.

8. A steam generator according to claim 7, in which said mixing section comprises: an outer case with an inner wall, and a venturi-like insert having an outer wall and two ends, one of which is welded to said outer case, and the other of which is spaced from said outer case in such a way that an annular gap is formed between said inner wall of said outer case and said outer wall of said insert, with that portion of said insert between said two ends thereof having a smaller outer diameter than either of said two ends so that an annular space is formed between said inner wall of said outer case and said outer wall of said insert, with said annular space communicating with said annular gap, whereby hot steam is adapted to flow axially through said insert, and cold steam is adapted to enter said annular space and from there to enter said hot steam via said annular gap.

9. A method of operating a steam generator having a circulating atmospheric or pressurized fluidized-bed combustion system that includes a fluidized-bed combustor, at least one separator, at least one fluidized-bed cooler connected downstream of said separator and adapted to be fed by a partial stream of the solids separated from combustion and fluidization gases, and a waste-heat boiler pass, with various ones of these components having disposed therein feed water heater heating surfaces, evaporator heating surfaces, and reheater heating surfaces, with at least one evaporator heating surface being disposed in said fluidized-bed combustor and at least one reheater heating surface being disposed in said fluidized-bed cooler, and with at least one adjustable by-pass line being connected in parallel to one of said heating surfaces, whereby at least one superheater heating surface is disposed in said fluidized-bed cooler together with said reheater heating surface, and a first adjustable by-pass line is associated with said reheater heating surface, said method including the step of selectively opening said by-pass line to a greater extent upon increase of said solids stream that is fed to said fluidized-bed cooler, and closing said by-pass line to a greater extent upon decrease of said solids stream.

* * * * *